US005356307A

United States Patent [19]

Dechelette

[11] Patent Number: 5,356,307

[45] Date of Patent: Oct. 18, 1994

[54] INSULATION DISPLACEMENT ELECTRICAL CONNECTOR SYSTEM

[75] Inventor: Helen Dechelette, Wissous, France

[73] Assignee: Molex Incorporated, Lisle, Ill.

[21] Appl. No.: 115,955

[22] Filed: Sep. 1, 1993

[30] Foreign Application Priority Data

Nov. 26, 1992 [EP] European Pat. Off. ..... 92120140.6

[51] Int. Cl.[5] ..... H01R 4/24

[52] U.S. Cl. ..... 439/421; 439/417

[58] Field of Search ..... 439/421, 422, 424, 417–419, 439/394

[56] References Cited

U.S. PATENT DOCUMENTS 4,955,816 9/1990 Roberts et al. ..... 439/421

5,125,821 1/1992 Peterson et al. ..... 439/421

*Primary Examiner*—David Pirlot

*Attorney, Agent, or Firm*—A. A. Tirva

[57] ABSTRACT

An electrical connector assembly is disclosed for terminating a plurality of insulated electrical wires and which includes a dielectric housing having a mating end and a wire-receiving end with a plurality of open-ended terminal-receiving cavities communicating therebetween. A plurality of terminals respectively are disposed in the cavities. Each terminal includes a mating end near the mating end of the housing, a wire-receiving end near the wire-receiving end of the housing and an axially collapsible insulation-displacement section therebetween. A dielectric cover is positionable against the housing at the wire-receiving end thereof. The cover has a plurality of wire-receiving openings aligned with the wire-receiving cavities in the housing. A plurality of pusher members are movably mounted on the cover at the openings therein for movement between inoperative positions and operative positions for collapsing the insulation-displacement sections of the terminals to slice through the insulation of the electrical wires. Therefore, any one of the pusher members can be moved independent of the other pusher members for selectively terminating the individual insulated electrical wires.

8 Claims, 2 Drawing Sheets

INSULATION DISPLACEMENT ELECTRICAL CONNECTOR SYSTEM

FIELD OF THE INVENTION

This invention generally relates to the art of electrical connectors and, particularly, to a connector system for terminating an insulated electrical cable or wire by insulation displacement thereof.

BACKGROUND OF THE INVENTION

Electrical connectors are widely used for interconnecting the circuitry components of electrically operated products and equipment. The connection and disconnection of cable or wire through the use of connectors permits convenience of assembly and maintenance as well as versatility in design.

Electrical connectors are of a wide variety and diverse construction. However, one common connector system includes a dielectric housing mounting a plurality of stamped and formed conductive terminals to which insulated multi-conductor cable or wiring may be electrically connected. Numerous terminal configurations; likewise are available, suited to the specific requirements of the application. A preferred terminal in many applications is one which has the capability of establishing electrical contact with the conductors of the cable by displacement of the insulative coating of the conductors, obviating the need to perform a separate step of stripping the insulative coating.

An extremely effective prior art insulation displacement terminal is shown in U.S. Pat. No. 4,512,619 to Dechelette, dated Apr. 23, 1985 and assigned to the assignee of this invention. Briefly, the terminal disclosed in that patent comprises a collapsible conductor engaging section into which an insulated wire may be axially inserted. The terminal is elongated and an electrical connection is established with a wire upon application of an axial force to the terminal directed generally parallel to the longitudinal axis of the wire, which is effective to collapse the collapsible conductor engaging section which slices through the insulation of the wire.

A plurality of terminals shown in the U.S. Pat. No. 4,512,619 patent may be mounted in a housing, with a corresponding plurality of insulated wires then axially advanced into the conductor engaging sections of the respective terminals. The wires may be mass terminated with the help of application tooling which causes the terminals to collapse inwardly to simultaneously collapse the conductor engaging sections of the terminals to displace the insulation of the wires and achieve high quality electrical connection with the conductors of the respective wires.

U.S. Pat. No. 4,955,816 to Roberts et al, dated Sep. 11, 1990 and assigned to the assignee of this invention, shows an improved electrical connector system utilizing terminals such as those shown in the U.S. Pat. No. 4,512,619 patent and which is self-terminating. Specifically, this patent discloses a modular rear housing or cover component mateable with either a front plug housing or a front receptacle housing which houses the axially displaceable terminals. The terminals can be mass terminated by inserting a plurality of wires into the modular rear housing or cover and by axially advancing the cover toward the front housing component of the system, the cover engaging the terminals and applying the necessary axial forces required to collapse the conductor engaging sections of the terminals. The housing components can be readily separated from one another for repair or replacement of the terminals.

This invention is directed to a further improvement in such insulation displacement connector systems, by providing an electrical connector assembly which allows for selective or individual termination of the respective terminals.

SUMMARY OF THE INVENTION

An object, therefore, of the invention is to provide a new and improved electrical connector system of the insulation displacement type of the character described.

In the exemplary embodiment of the invention, an electrical connector assembly is provided for terminating a plurality of insulated electrical wires. The assembly includes a dielectric housing having a mating end and a wire-receiving end, with a plurality of open-ended terminal-receiving cavities communicating therebetween. A plurality of terminals are respectively mounted in the cavities. Each terminal includes a mating end near the mating end of the housing, a wire-receiving end near the wire-receiving end of the housing and an axially collapsible insulation-displacement section therebetween. A dielectric rear housing component or cover is positionable against the housing at the wire-receiving end thereof. The cover has a plurality of wire-receiving openings aligned with the wire-receiving cavities in the housing.

The invention contemplates the provision of a plurality of discrete pusher members movably mounted on the cover at the openings therein for movement between inoperative positions and operative positions for collapsing the insulation-displacement sections of the terminals to slice through the insulation of the electrical wires. Therefore, any one of the pusher members can be moved independent of the other pusher members for selectively terminating the individual insulated electrical wires. As disclosed herein, the pusher members are generally tubular in shape to define open-ended structures providing wire-receiving passages therethrough aligned with the wire-receiving openings in the cover and the wire-receiving cavities in the housing.

Another feature of the invention is to integrally join the pusher members to the cover by frangible means. Specifically, the cover, the pusher members and the frangible means all are unitarily molded of dielectric material such as plastic or the like. The frangible means are structurally sized and shaped to be frangible by forces less than the forces required to collapse the insulation-displacement sections of the terminals. The frangible means may be broken either before or during mounting of the cover to the housing. By integrally molding the pusher members to the cover by the frangible means, fabrication processes are extremely simple.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
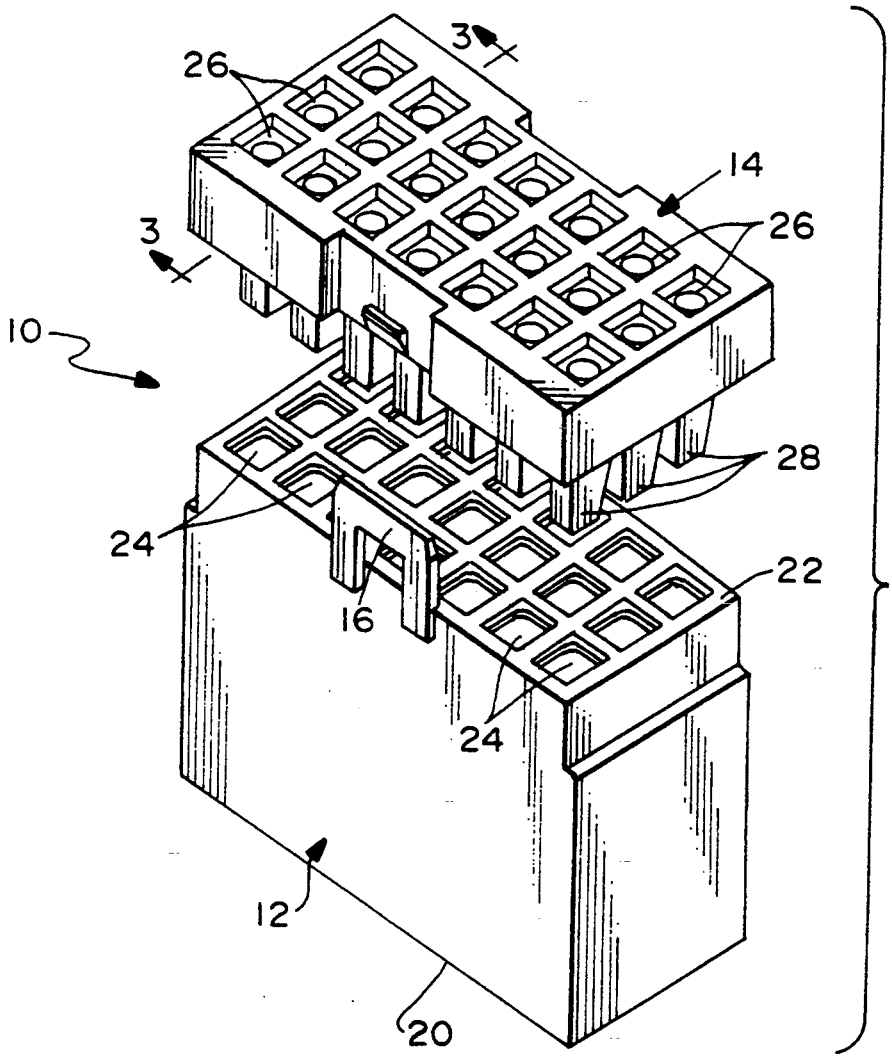
FIG. 1 is a perspective view of an electrical connector assembly embodying the concepts of the invention.

Referring to the drawings in greater detail, and first to FIG. 1, the invention is embodied in an electrical connector assembly, generally designated 10, for terminating a plurality of insulated electrical wires (not shown). The assembly includes a dielectric housing, generally designated 12, and a rear housing component or cover, generally designated 14. Both the housing and the cover each are unitarily molded of plastic or like material. Housing 12 includes an integral resilient latch arm 16, and cover 14 includes a complementary interengaging latch boss 18 for latching the cover and housing together in assembled condition. One latch arm 16 and latch boss 18 are provided on each side of the assembly.

Dielectric housing 12 has a mating end 20, a wire receiving end 22 and a plurality of wire-receiving cavities 24 communicating therebetween. Dielectric cover 14 is positionable against housing 12 at the wire.-receiving end 22 thereof, and the cover has a plurality of wire-receiving openings 26 extending therethrough and aligned with wire-receiving cavities 24 in housing 12 when the cover is assembled to the housing. As will be described in greater detail hereinafter, cover 14 includes a plurality of terminating pusher members 28 molded integral therewith, projecting toward housing 12 and insertable into the wire-receiving ends of cavities 24 in the housing.

Figure 2:
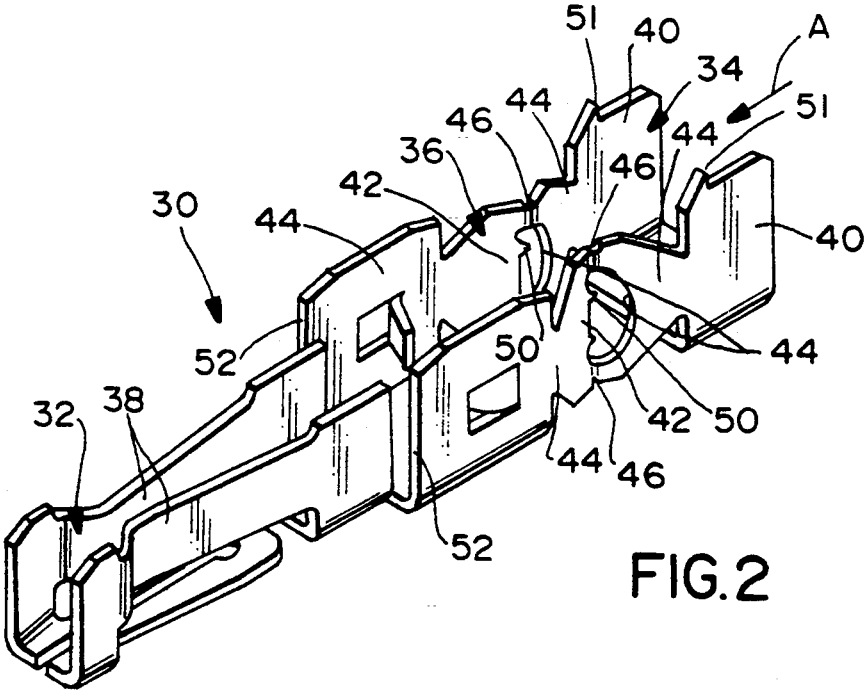
FIG. 2 is a perspective view, on an enlarged scale, of one of the terminals of the connector assembly.

Referring to FIG. 2, a terminal, generally designated 30, is shown for mounting in each of terminal-receiving cavities 24 of housing 12. The terminal is of the general type originally disclosed in the aforementioned U.S. Pat. No. 4,512,619. Generally, the terminal is stamped and formed from sheet metal material, is elongated and defines a mating end, generally designated 32, a wire receiving end, generally designated 34, and an intermediate collapsible insulation displacement section, generally designated 36, between the ends. Mating end 32 includes a pair of cantilevered spring arms 38 which mate with an appropriate male terminal of a complementary mating connector assembly (not shown). Wire-receiving end 34 includes a pair of laterally spaced side walls or arms 40 between which an insulated wire can be inserted generally in the direction of arrow "A".

The intermediate collapsible section 36 of terminal 30 includes a pair of opposed contacting sections 42 between reduced width portions 44 so that the contacting sections can be collapsed or bent inwardly into a shallow V-shape in response to an axial force on the terminal generally parallel to the insulated wire, i.e. generally in the direction of arrow "A". Each contacting section 42 includes a pair of notches 46 which define axes about which the sections can be collapsed or bent inwardly. Apertures 48 also are formed in the contacting sections, with teeth 50 projecting into the apertures for slicing into the insulative coating of a typical insulated electrical cable or wire. Walls 40 at the wire-receiving end of the terminal are provided with teeth 51 for skiving into the plastic material of housing 12 within cavities 24. Lastly, terminal 30 is provided with shoulder means 52 facing in the mating direction of the terminal.

Figure 3:
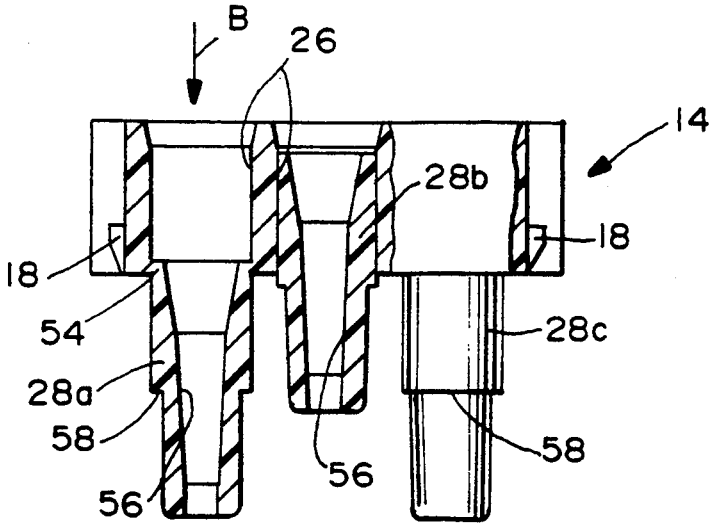
FIG. 3 is a vertical section through the cover, taken generally in the direction of line 3—3 of FIG. 1, with one of the illustrated pusher members broken from the cover, and with the other two pusher members still being integral with the cover.

Referring to FIG. 3, a partially fragmented section through cover 14 shows three of the pusher members 28 as described in relation to FIG. 1, but the three pusher members are identified as **28*a*, 28*b* and 28*c* in FIG. 3 in order to facilitate the following description. More particularly, as stated above, cover 14 is unitarily molded of dielectric material such as plastic or the like and including the pusher members. It can be seen by pusher member 28*a* that a thin or weakened area 54 of the plastic material integrally joins the pusher members with the cover. Each pusher member is generally tubular in shape, rectangular in cross-section and thereby defines a wire-receiving passage 56 therethrough. The passage is aligned with a respective one of the wire-receiving openings 26 in the cover. The passage also is aligned with a respective cavity 24 in housing 12 when the cover is assembled to the housing. An insulated wire is (not shown) inserted into cover 14 and through passage 56 in the direction of arrow "B" (FIG. 3). This direction of arrow "B" also coincides with the wire-insertion direction identified by arrow "A" in FIG. 2. Lastly, the outside surface of each pusher member includes a stepped configuration to define a peripheral shoulder 58**.

Still referring to FIG. 3, it can be seen that the center pusher member **28*b* has been separated from cover 14 by breaking its respective frangible means or section 54, whereby pusher member 28*b* has been moved upwardly into its respective opening 26 in the cover. It should be noted that the outside dimensions of the pusher members and the inside dimensions of openings 26 are such as to provide an interference fit whereby the pusher members can be at least temporarily held in the position shown by pusher member 28*b*. This can be considered the inoperative position of the pusher members. Pusher member 28*c* in FIG. 3 is shown in elevation to illustrate the full extent of shoulder 58. Pusher member 28*c* still is integrally joined to cover 14 by the frangible means 54 described in relation to pusher member 28*a***.

Figure 4:
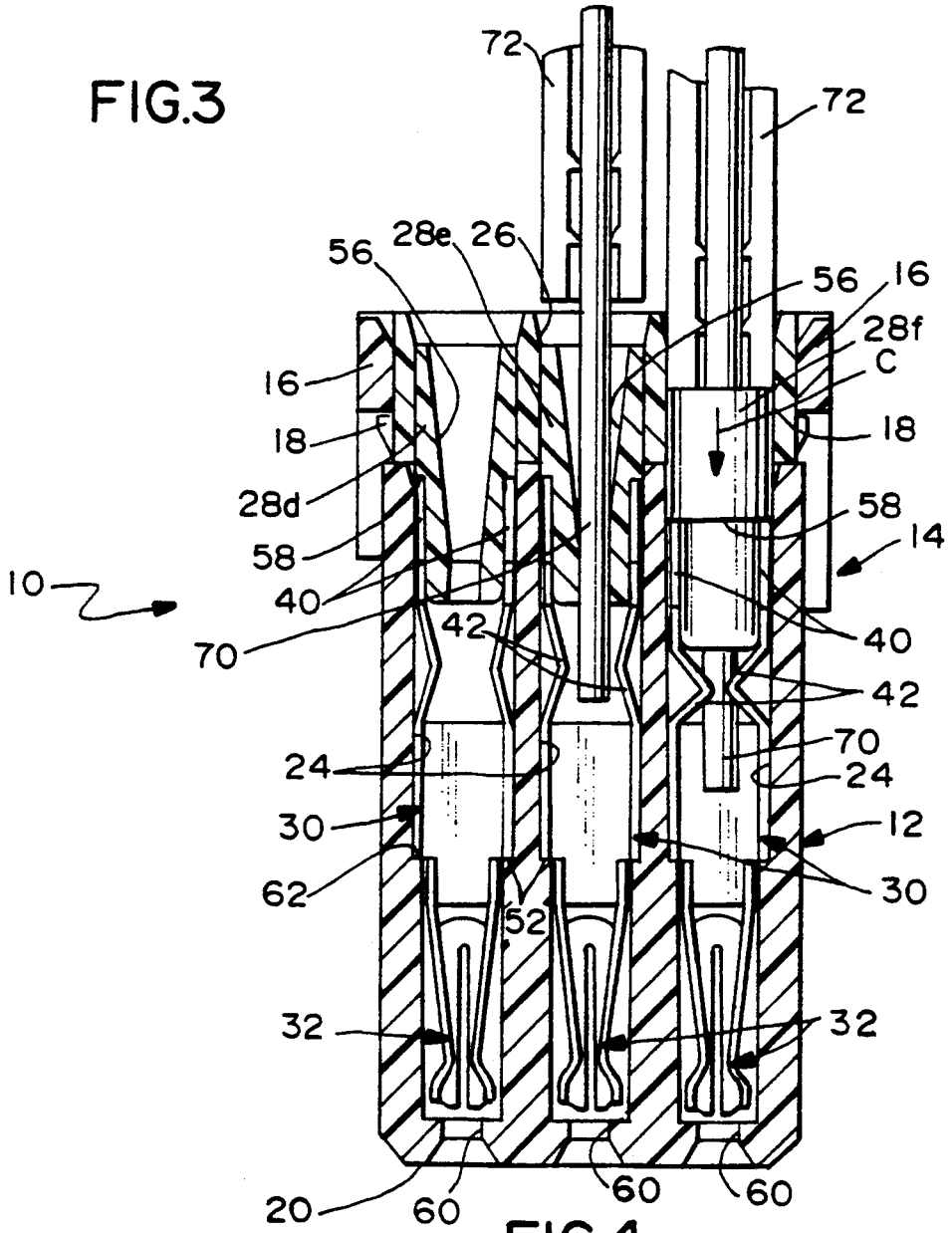
FIG. 4 is a vertical section through the electrical connector assembly, in assembled condition, with one of the pusher members in an inoperative position, another pusher member having a wire inserted thereinto but not terminated, and a third pusher member in operative position fully terminating the respective terminal.

FIG. 4 shows cover 14 assembled to housing 12, with resilient latch arms 16 of the housing snapped over latch bosses 18 of the cover to latch the cover to the housing. Three of terminals 30 (FIG. 2) are shown mounted within respective terminal-receiving cavities 24 in the housing. It can be seen that mating end 20 of the housing includes a plurality of holes 60 aligned with the cavities and into which male terminals can be inserted for interengagement with mating ends 32 of the terminals. The terminals are inserted into cavities 24 from the top of the housing and, when in their fully loaded positions, shoulders 52 of the terminals abut against stop shoulders 62 formed within the respective cavities in the housing.

FIG. 4 also shows three of the pusher members 15 28 described above in relation to FIGS. 1 and 3, but the pusher members are identified in FIG. 4 as **28*d*, 28*e* and 28*f* in order to facilitate the following description. More particularly, pusher member 28***d* is shown broken or severed from cover 14 and moved upwardly to its inoperative position, as described above in relation to pusher member 28*b* in FIG. 3. In this inoperative position, it can be seen that shoulder 58 of pusher member 28*d* engages against walls 40 at the top of the respective terminal 30 when the cover is assembled to the housing.

Center pusher member 28*e* is shown in FIG. 4 in its inoperative position as described above in relation to pusher member 28*d*. However, it can be seen that an insulated wire 70 has been inserted through wire-receiving opening 26 in cover 14, through passage 56 in pusher member 30 28*e* and into position between collapsible contacting sections 42 of the respective terminal 30. Passages 56 in the pusher members are shown to have an inwardly tapered configuration whereby the lower ends of the passages have inside dimensions sufficient to allow wires 70 to be inserted therethrough but to provide a grip on the wires. An appropriate tool 72 is shown partially about the insulated wire. The tool should have transverse dimensions to fit through openings 26 in the cover but sufficiently wide to abut against the top of the pusher members.

Therefore, and looking at pusher member 28*f* in FIG. 4, it can be seen that the pusher member has been moved or pushed downwardly by tool 72 in the direction of arrow "C" moving the wire therewith further into an area between collapsible contacting sections 42 of the respective terminal 30. Since shoulder 58 of pusher member 28*f* engages walls 40 of the terminal, the pusher member is effective to collapse sections 42 of the terminal inwardly as shown in FIG. 4, whereby the collapsible sections slice into the insulation of wire 70 to establish an electrical connection with the conductor within the wire.

From the foregoing, it can be understood that pusher members 28 (28*a*–28*f*) are effective to provide a means for individually and selectively terminating terminals 30 with respective insulated wires properly inserted into the terminals. Cover 14 can be preconditioned with all of the pusher members being broken so that the pusher members are in their inoperative positions shown by pusher member 28*b* in FIG. 3 (and pusher members 28*d* and 28*e* in FIG. 4) prior to assembling cover 14 to housing 12. Or, in the alternative, frangible means 54 can be weakened or made sufficiently thin as to be frangible by forces less than the forces required to collapse contacting sections 42 of the terminals. With this latter scheme, cover 14 can be assembled to housing 12 with the pusher members projecting therefrom as shown in FIG. 1 or as shown by pusher members 28*a* and 28*c* in the FIG. 3. As the cover is assembled, the pusher members will be broken and moved to their inoperative positions as shown by pusher member 28*b* in FIG. 3 simply by engagement with walls 40 of terminals 30. An appropriate tool, such as shown at 72, can be inserted into openings 28 in cover 14 for engaging the pusher members in a selective fashion to individually move the pusher members from their inoperative positions to their operative positions collapsing and terminating terminals 30 to the insulated wires.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In an electrical connector assembly for terminating a plurality of insulated electrical wires and which includes a dielectric housing having a mating end and wire-receiving end with a plurality of open-ended terminal-receiving cavities communicating therebetween, a plurality of terminals respectively disposed in the cavities, each terminal including a mating end nearer the mating end of the housing, a wire-receiving end nearer the wire-receiving end of the housing and an axially collapsible insulation-displacement section therebetween, and a dielectric cover positionable against the housing at the wire-receiving end thereof, the cover having a plurality of wire-receiving openings aligned with the wire-receiving cavities in the housing, characterized in that a plurality of pusher members movably mounted on the cover at the openings therein for movement between inoperative positions and operative positions for collapsing the insulation-displacement sections of the terminals to slice through the insulation of the electrical wires, whereby any one of the pusher members can be moved independent of the other pusher members for selectively terminating the individual insulated electrical wires.

2. In an electrical connector assembly as set forth in claim 1, wherein said pusher members are open-ended to define wire-receiving passages therethrough aligned with the wire-receiving openings in the cover and the wire-receiving cavities in the housing.

3. In an electrical connector assembly as set forth in claim 2, wherein said pusher members are generally tubular in shape.

4. In an electrical connector assembly as set forth in claim 1, wherein said pusher members are joined to the cover member by frangible means.

5. In an electrical connector assembly as set forth in claim 4, wherein said cover, said pusher members and said frangible means all are unitarily molded of dielectric material such as plastic and the like.

6. In an electrical connector assembly as set forth in claim 5, wherein said frangible means are structurally sized and shaped to be frangible by forces less than the forces required to collapse the insulation-displacement sections of the terminals.

7. In an electrical connector assembly as set forth in claim 6, wherein said pusher members are open-ended to define wire-receiving passages therethrough aligned with the wire-receiving openings in the cover and the wire-receiving cavities in the housing.

8. In an electrical connector assembly as set forth in claim 7, wherein said pusher members are generally tubular in shape.

* * * * *